US010672229B2

(12) United States Patent
Guinn et al.

(10) Patent No.: US 10,672,229 B2
(45) Date of Patent: Jun. 2, 2020

(54) CASINO PATRON SERVICE VALIDATION DEVICE

(71) Applicant: Ardent Progressive Systems and Games, LLC, Las Vegas, NV (US)

(72) Inventors: Robert Gerald Guinn, Henderson, NV (US); Bradley Pederson, Park City, UT (US); Kelly Khamis, Henderson, NV (US)

(73) Assignee: Ardent Progressive Systems and Games, LLC, Las Vegas, NV (US)

( * ) Notice: Subject to any disclaimer, the term of this patent is extended or adjusted under 35 U.S.C. 154(b) by 232 days.

(21) Appl. No.: 15/901,688

(22) Filed: Feb. 21, 2018

(65) Prior Publication Data

US 2018/0174399 A1 Jun. 21, 2018

Related U.S. Application Data

(63) Continuation-in-part of application No. 15/151,395, filed on May 10, 2016, now abandoned.

(60) Provisional application No. 62/601,070, filed on Mar. 10, 2017, provisional application No. 62/179,515, filed on May 11, 2015.

(51) Int. Cl.
*G07F 17/32* (2006.01)

(52) U.S. Cl.
CPC ..... *G07F 17/3255* (2013.01); *G07F 17/323* (2013.01); *G07F 17/3211* (2013.01); *G07F 17/3239* (2013.01); *G07F 17/3248* (2013.01)

(58) Field of Classification Search
None
See application file for complete search history.

(56) References Cited

U.S. PATENT DOCUMENTS

| | | | | |
|---|---|---|---|---|
| 4,837,728 | A * | 6/1989 | Barrie | G07F 17/32 273/143 R |
| 5,761,647 | A | 6/1998 | Boushy | |
| 5,971,271 | A | 10/1999 | Wynn et al. | |
| 6,003,013 | A | 12/1999 | Boushy et al. | |
| 6,183,362 | B1 | 2/2001 | Boushy | |
| 6,302,793 | B1 | 10/2001 | Fertitta, III et al. | |
| 7,775,876 | B2 | 8/2010 | Rowe | |
| 7,780,529 | B2 | 8/2010 | Rowe et al. | |
| 8,452,687 | B2 | 5/2013 | Rowe | |
| 8,979,646 | B2 | 3/2015 | Moser et al. | |

(Continued)

OTHER PUBLICATIONS

Declaration of Robert Guinn, filed Jun. 18, 2018, 5 pages.
Search Report and Written Opinion for International Patent Application No. PCT/US2018/021205, dated Jun. 4, 2018, 16 pages.

*Primary Examiner* — Kevin Y Kim
(74) *Attorney, Agent, or Firm* — Weide & Miller, Ltd.

(57) ABSTRACT

Methods, systems, and devices are provided for validating player entitlement to an award or service, such as complimentary goods or services or paid for goods or services, such as based upon game play activity and/or time since a last award or service. A validation system may include at least one wager-based gaming device. The system also has a validation module connected to the gaming device. The validation module may receive information from the gaming device or external devices. The validation module includes a visual notification output that provides a visual notification of the player's eligibility for an award or service.

20 Claims, 5 Drawing Sheets

(56) References Cited

U.S. PATENT DOCUMENTS

| | | | | |
|---|---|---|---|---|
| 2002/0187828 | A1* | 12/2002 | Benbrahim | G07F 17/323 463/29 |
| 2004/0002386 | A1 | 1/2004 | Wolfe et al. | |
| 2006/0073888 | A1 | 4/2006 | Nguyen et al. | |
| 2009/0055205 | A1 | 2/2009 | Nguyen et al. | |
| 2011/0306400 | A1 | 12/2011 | Nguyen | |
| 2014/0256412 | A1 | 9/2014 | Colvin et al. | |
| 2015/0005060 | A1* | 1/2015 | Shankar | G07F 17/329 463/26 |
| 2015/0031444 | A1 | 1/2015 | Colvin et al. | |
| 2016/0335846 | A1 | 11/2016 | Guinn et al. | |

* cited by examiner

CASINO PATRON SERVICE VALIDATION DEVICE

CROSS REFERENCE TO RELATED APPLICATION

This application claims priority to U.S. Provisional Application No. 62/601,070 which was filed on Mar. 10, 2017 and is a continuation-in-part of U.S. application Ser. No. 15/151,395 which was filed on May 10, 2016, which application claims priority to U.S. Provisional Application No. 62/179,515 which was filed on May 11, 2015, the contents each of which are hereby incorporated by reference.

BACKGROUND

Many gaming establishment that provide gaming machine and table games to patrons offer complimentary items to the patrons to encourage the patrons to continue playing the games and as consideration for the patrons' business. For example, gaming establishments such as casinos, pubs, or other venues may offer free beverages or food items to players while the players play at a gaming machine or gaming table.

Many casinos and pubs with gaming machines have integrated player tracking systems. One of the purposes of the player tracking system is to reward players for patronizing their location and gambling at their machines. Part of these rewards includes providing complimentary gifts ("comps"). Such gaming machines are typically located in proximity of hosts and/or bartenders that give additional complimentary gifts or rewards to players that wager or gamble on the gaming machines. Such gifts are often in the form of beverages or food.

Due to the expense of providing complimentary rewards, casino operators often wish to ensure that the players are actually playing games at the machines, and not merely loitering at the location, before providing the complimentary rewards. In some instances, the casino operators may attempt to base complimentary gifts provided by hosts or bartenders on data received using the player tracking systems. However, even with such player tracking systems, it is difficult to determine and to communicate to a host or bartender which players are deserving of complimentary gifts.

For example, it is virtually impossible for a casino to manually track service of comps, such as drinks, to players of different gaming machines to ensure that enough time passes between serving comps and to ensure that the players are deserving of the comps. This is due to the sheer number of gaming machines and players at an establishment, as well as the fact that the player moves from gaming machine to gaming machine. The different establishment employees such as servers working in different areas of the establishment have no practical possibility of ensuring comps are consistently served at the right times to the right players. Thus, a way to leverage a technological solution to this problem is desired.

SUMMARY

Embodiments of the invention comprise methods, systems, and devices for validating player entitlement to complimentary or paid for awards or services. In one embodiment, a validation system may include a gaming device comprising having a controller, at least one electronic display, at least one wager accepting device configured to receive a physical item representing a monetary value to increase a credit balance maintained at the gaming device, and at least one player input device configured to place a wager on a game of presented at the gaming device. The system also has a validation module connected to the gaming device. The validation module receives information from the gaming device of one or more wagers placed during the game presented at the gaming device via the at least one player input device. The validation module includes a visual notification output that provides a visual notification based on the information of the wagers placed to validate entitlement to awards or services to the player.

In some embodiments, the visual notification output is one or more LEDs. The validation module may provide the visual notification when an amount of funds associated with or input to the gaming machine reaches or exceeds a predetermined threshold. In another example, the validation module may provide the visual notification when an amount of wagers reaches or exceeds a predetermined threshold during a given time period.

Other configurations may also be used. For example, the validation module may provide the visual notification when an amount of the one or more wagers on average reaches or exceeds a predetermined threshold during a given time period. The validation module may also provide a first visual notification when an amount of the one or more wagers reaches or exceeds a first predetermined threshold, and a second visual notification when an amount of the one or more wagers reaches or exceeds a second predetermined threshold greater than the first predetermined threshold. Additionally, the validation module may provide a first visual notification when an average amount of the one or more wagers during a given time period reaches or exceeds a predetermined threshold, and a second visual notification when an average amount of the one or more wagers during a given time period falls below a predetermined threshold.

In another exemplary embodiment, a method for validating player entitlement to an award or services is provided. The method may include providing a gaming device comprising a controller, at least one electronic display, at least one wager accepting device configured to receive a physical item representing a monetary value to increase a credit balance maintained at the gamine device, and at least one player input device configured to place a wager on a game of presented at the gaming device. A validation module may be connected to the gaming device and may have at least one visual notification output.

The method may further include receiving information from the gaming device at the validation module of one or more wagers placed during the game presented at the gaming device via the at least one player input device. Based on the information received, the method may also include providing a visual notification via the visual notification output based on the one or more wagers placed.

In other embodiments, a validation module is provided that comprises a gaming device interface configured to send and receive information from a gaming device and a gaming system connected to the gaming device, at least one input device, at least one visual indicator; and an electronic control unit. The electronic control unit controls the gaming device interface, receives an input signal from the at least one input device, and activates the at least one visual indicator. The electronic control unit provides a visual notification via the at least one visual indicator to signify that the patron is eligible to be served or awarded another product (whether complimentary or paid for) based on the time since served value and the one or more wagers. The electronic control unit calculates a time since served or receives such information from a remote server for use in triggering the visual notification.

In one embodiment, the time since served value is reset when the electronic control unit receives the input signal from the at least one input device or via a remote server or from a secondary input device. The visual notification may be provided when an average amount of the one or more wagers during a given time period is greater than a first predetermined threshold, and when the time since served value is greater than a second predetermined threshold.

Further objects, features, and advantages of the present invention over the prior art will become apparent from the detailed description of the drawings which follows, when considered with the attached figures.

DETAILED DESCRIPTION OF EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise systems, methods and devices for validating the complementary or paid for goods and/or services provided to players at a gaming establishment. In one embodiment, the validation comprises determining that a player is entitled to a free or reduced price good or service (which are often referred to as "complimentary" goods or services when such are free, or just a "comp") and providing a visual indication of the validation status. In one embodiment, the validation may comprise determining that the player has met certain game play activity requirements. In another embodiment, the validation may comprise determining that a certain amount of time has passed since a last award or service. In yet other embodiments, the validation may comprise a determination of a combination of factors such a passage of a period of time and certain game play requirements. The method may be implemented, for example relative to a gaming machine or device. Such a gaming machine may have various configurations.

The gaming machine may be located at a casino (and as such may be referred to as a "casino gaming machine"). As described below, the gaming machine may be part of a gaming system, such as a casino gaming system which links two or more of the gaming machines or one or more gaming machines with other devices, such as one or more table games, kiosks, accounting systems or servers, progressive systems or servers, player tracking systems or servers or the like.

Figure 1:
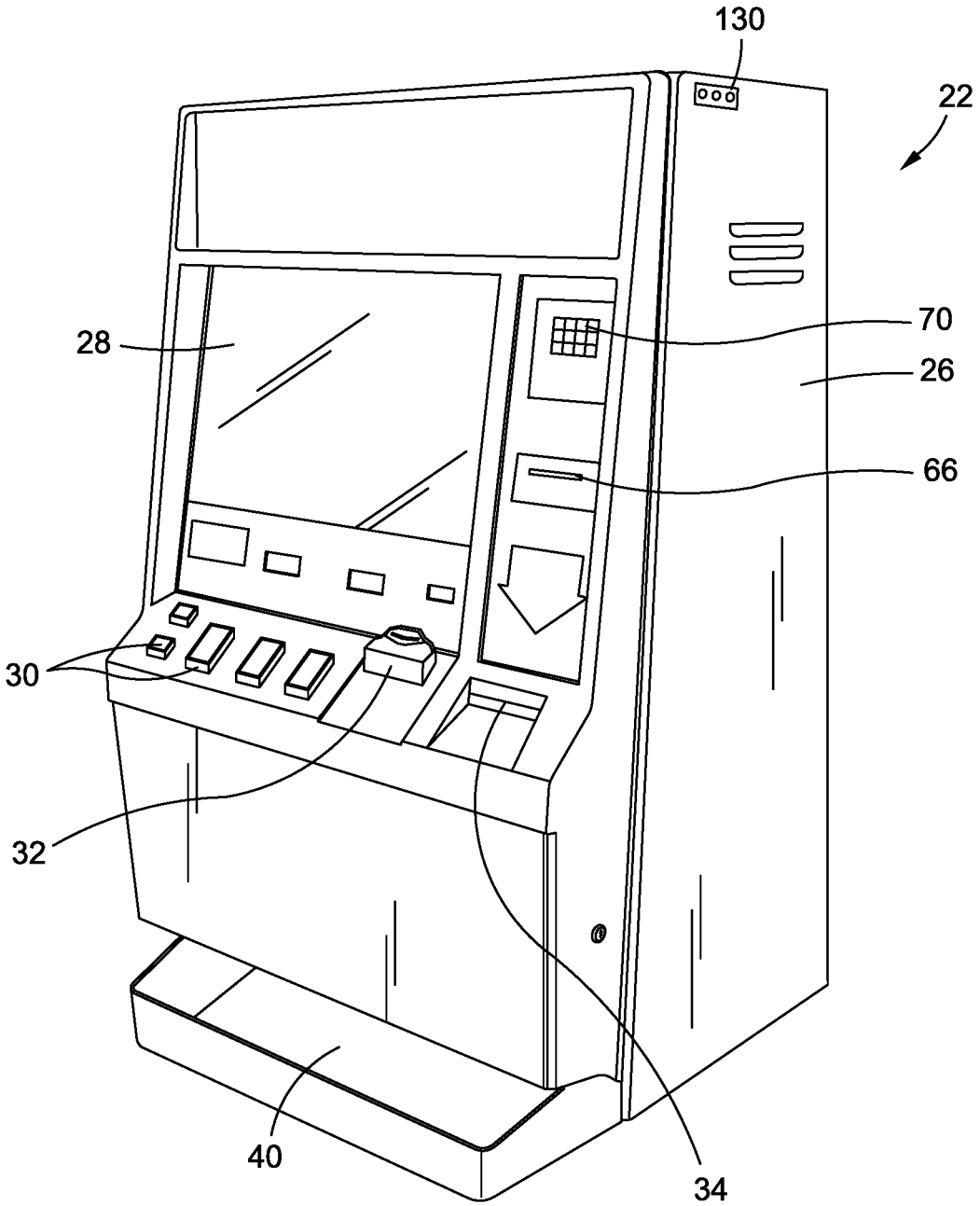
FIG. 1 illustrates a gaming machine according to one exemplary embodiment.
Figure 2:
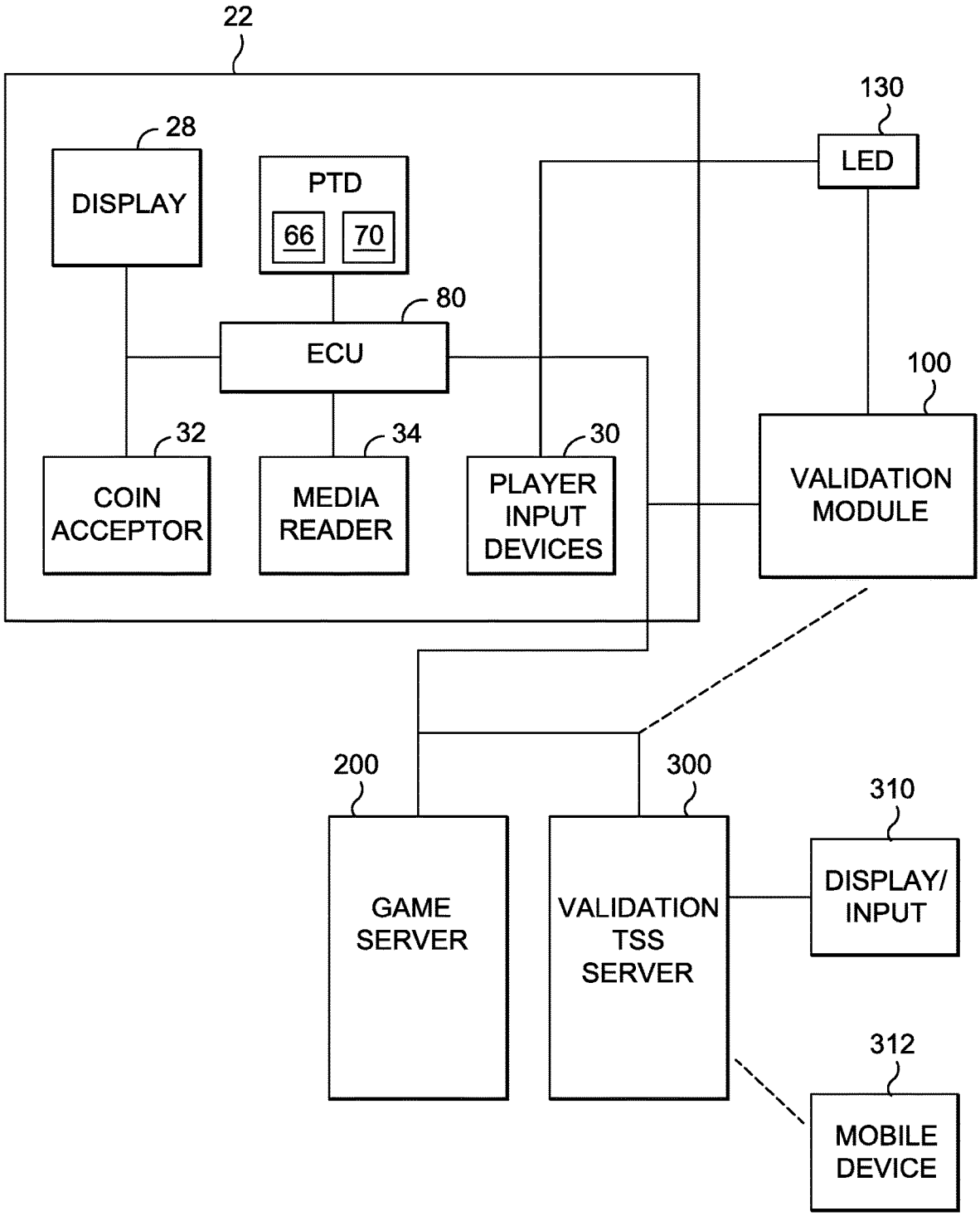
FIG. 2 illustrates a schematic of a gaming machine according to one exemplary embodiment.

One configuration of a gaming machine 22 is illustrated in FIGS. 1 and 2. As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one display device 28 configured to display game information. The display device 28 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display 28 may be capable of projecting or displaying a wide variety of information, including images, symbols and other indicia or information associated with game play, game promotion or other events. The gaming machine 22 might include more than one display device 28, such as two or more displays 28 which are associated with the housing 26. The gaming machine 22 might also include a top box or other portion. Such a top box might include one or more display devices 28, such as in addition to one or more main displays which are associated with the housing 26. Also, the gaming machine 22 might include side displays (such as mounted to the exterior of the housing 26) and might include multiple displays of differing sizes.

While the display devices may comprise one or more video displays, in another embodiment, the gaming machine 22 may include one or more physical reels capable of displaying game information, such as slot symbols. In such a configuration, means are provided for rotating the physical reels. In one or more embodiments, the means may comprise a mechanical linkage associated with a spin arm, with movement of the spin arm (a "pull") by a user causing the reels to spin. In such an arrangement, the reels are generally allowed to free-wheel and then stop. In another embodiment, electronically controlled mechanisms are arranged to rotate and stop each reel. Such mechanisms are well known to those of skill in the art. In this arrangement, actuation of the spin arm or depression a spin button causes a controller (not shown) to signal the activation of the spin mechanism associated with one or more of the reels. Preferably, the controller is arranged to either turn off the signal to the device(s) effecting the rotation of each or all of the reels or generates a signal for activating a braking device, whereby the reels are stopped. The principal of such an arrangement is described in U.S. Pat. No. 4,448,419 to Telnaes, which is incorporated herein by reference.

As described in more detail below, the gaming machine 22 is preferably configured to present one or more games upon a player making a monetary payment or wager. In this regard, as described in more detail below, the gaming machine 22 includes means for accepting monetary value.

In one embodiment, as detailed above, certain game outcomes may be designated as winning outcomes. Prizes or awards may be provided for winning outcomes, such as monetary payments (or representations thereof, such as prize of credits), or promotional awards as detailed herein. As detailed below, the gaming machine 22 includes means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game, to indicate cards to be held or discarded, to "cash out" of the gaming machine, or to provide various other inputs.

In one preferred embodiment, the gaming machine 22 includes at least one microprocessor or controller 80 for controlling the gaming machine, including receiving player input and sending output signals for controlling the various components of the machine 22 (such as generating game information for display by the display 28). The controller 80 may be arranged to receive information regarding funds provided by a player to the gaming machine, receive input such as a purchase/bet signal when a purchase/bet button is depressed, and receive other inputs from a player. The controller 80 may be arranged to generate information regarding a game, such as generating game information for display by the at least one display 28, for determining winning or losing game outcomes and for displaying information regarding awards for winning game outcomes, among other things.

The controller 80 may be configured to execute machine readable code or "software" or otherwise process information, such as obtained from a remote server. Software or other instructions may be stored on a memory or data storage device. The memory may also store other information, such as pay table information. The gaming machine 22 may also include one or more random number generators for generating random numbers, such as for use in selecting slot symbols, cards or other game symbols, and for presenting the game in a random or pseudo-random fashion (e.g. whereby the game is presented in a manner in which the player cannot control the outcome but where the player may or may not provide player input).

Preferably, the controller 80 is configured to execute machine readable code or instructions which are configured to implement game play. For example, the controller 80 of the gaming machine 22 may be configured to detect a wager, such as a signal from a player's depressing of the "bet one" button. Upon such an event and/or the player otherwise signaling the gaming machine to present the game, the controller 80 may be configured to cause game symbols or other game information to be displayed on the at least one display 28. The controller 80 may accept input from a player of game inputs, such as a request to hold or discard cards, spin reels or the like, via the one or more player input devices of the gaming machine 22.

The gaming machine 22 may be configured to generate and present games in a stand-alone manner or it may be in communication with one or more external devices at one or more times. For example, the gaming machine 22 may be configured as a server-based device and obtain game code or game outcome information from a remote game server 200 (in which event the gaming machine controller may receive game information from the server 200, such as game outcome information, and use that server-generated information to present the game at the gaming machine).

As indicated, the gaming machine 22 is configured to present one or more wagering games. Thus, the gaming machines 22 is preferably configured to accept value, such as in the form of coins, tokens, paper currency or other elements or devices representing value such as monetary funds. For example, as illustrated in FIGS. 1 and 2, the gaming machine 22 might include a coin acceptor 32 for accepting coins. Of course, associated coin reading/verifying devices and coin storage devices may be associated with the gaming machine 22 if it is configured to accept coins. Likewise, the gaming machine 22 might include a media reader 34. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read FOBs, magnetic stripe cards or other media having data associated therewith and via which value or funds may be associated with the gaming machine 22. Funds might also be associated via other devices, such as electronic transfer via a Wi-Fi or Bluetooth wireless link to a player's smart phone or the like.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. For example, upon an award or at cash-out, associated funds may be paid to the player by the gaming machine 22 dispensing coins to a coin tray 40. In another embodiment, funds may be issued by dispensing paper currency. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference.

The gaming machine 22 may also include a player tracking device, such as a card reader 66 and associated keypad 70. Such player tracking devices are well known and may permit the game operator to track play of players of the gaming machine. The gaming machine 22 may include one or more communication interfaces or ports to enable the exchange of information or communication with external devices or systems, such an external player tracking host, accounting system or the like. For example, the gaming machine 22 may include a primary and a secondary slot accounting system or "SAS" port which facilitates reporting of gaming machine related activity (such as amounts wagered at the gaming machine 22) by the gaming machine to an accounting system.

A casino may have numerous such gaming machines 22, such as located on a casino floor or in other locations. Of course, such gaming machines 22 might be used in other environments, such as an airport, a bar or tavern or other locations.

It will be appreciated that the gaming machine illustrated in FIGS. 1 and 2 is only exemplary of one embodiment of a gaming machine. For example, it is possible to for the gaming machine to have various other configurations, including different shapes and styles and having different components than as just described.

The gaming machine shown in FIGS. 1 and 2 may be configured with or be modified to include a validation module 100. In one embodiment, the validation module 100 comprises at least a visual status indicator, such as one or more lights including incandescent, fluorescent, halogen, LED, OLED, etc.; flags, or other mechanically actuated display mechanisms; a display screen such as a OLED or LCD panel; or any other mechanism for providing a visual indication of a player's validation status as detailed herein. For example, in this embodiment the visual status indicator may comprise at least one LED 130.

As mentioned above, the gaming machine 22 may be connected to a game server 200 through which gaming information is received at the gaming machine 22. A Validation and Time Since Served ("TSS") server may also be provided. The validation module 100 may connect to the Validation/TSS server 300 via the connection with the gaming machine 22, or directly, such as via a wired connection or a wireless connection using any acceptable wireless protocol such as Bluetooth, Wi-Fi, etc. Accordingly, the validation module 100 may operate in a stand-alone fashion, may transmit information to and/or receive operating instruction from the Validation/TSS server 300, or may operate using a combination of both stand-alone operation and remote operation.

As shown in FIG. 2, the Validation/TSS Server 300 may be connected to a display and an input device 310, such as a touchscreen. The display may be used by a host or server to view a status of the validation module 100, to send control instructions to the validation module 100, or the like. Further, one or more mobile devices 312 may wireless connect or communication with the Validation/TSS server 312 to interact with it and/or the validation module 100.

Figure 3:
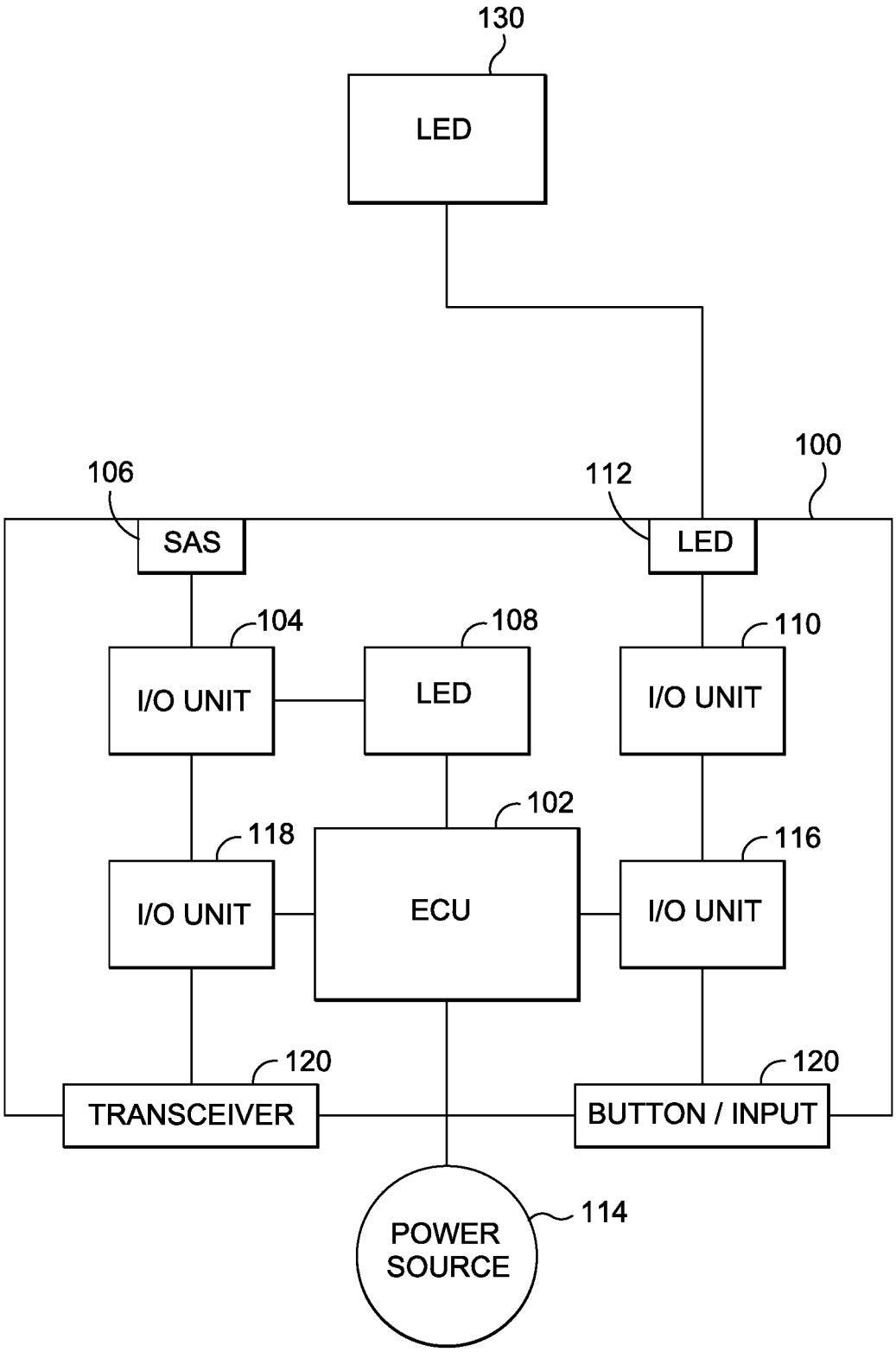
FIG. 3 illustrates a schematic of a patron compensation validation device, according to one exemplary embodiment.

An example of a validation module is shown in FIG. 3. As illustrated, the validation module 100 may comprise an electronic control unit 102. The electronic control unit 102 may comprise a memory (such as for storing data, code/software, etc.) and a microprocessor (for executing instructions, such as machine-readable code stored in the memory). The controller 102 is connected to a plurality of input/output devices 104, 110, 116, 118. One input/output device 104 may be configured to connect the validation module 100 with the gaming machine 22. In this embodiment, the input/output devices 104 is connected to or configured as a SAS port 106 (e.g. is configured to implement a SAS communication protocol and has associated physical connectors for connecting an appropriate cable thereto which leads to a slot accounting system ("SAS" port of the gaming machine). The validation module 100 may thus be connected to the SAS port of a gaming machine 22, thus enabling the validation module 100 to receive information from the gaming machine 22 or from the game server 200 and/or validation/TSS server 300.

In one embodiment, the gaming machine 22 may be connected to an accounting system via its primary SAS port and thus the validation module 100 may communicate with the gaming machine 22 via connection to the gaming machine's secondary SAS port (in one embodiment, if such a port is already utilized, a port sharing feature may be implemented whereby the validation module utilizes and releases the port at certain intervals to share the port with other devices, etc.). Of course, other types of input/output devices 104 might be utilized to facilitate communications with the gaming machine 22, such as to receive information from the gaming machine, including different types of physical connectors or interfaces and utilizing different communication protocols. As one example, the validation module 100 might be configured to communicate with a gaming machine 22 using a system to system ("S2S") protocol. In other embodiments, the validation module 100 may be connected to the gaming machine 22 via other wired and/or wireless connections.

The validation module 100 further comprises an LED port 112 corresponding to the input/output unit 110. The LED 130 is connected to the LED port 112, such that the validation module 100 drives the output to the LED 130. The LED 130 may comprise several LEDs to emit multiple colors (the LED might comprise a LED capable of emitting different colors or multiple individual LED elements capable of emitting different colors). In some embodiments, other light or visual devices may be used in place of the LED without departing from the scope of the invention, as detailed above.

The validation module 100 may further comprise one or more feedback LEDs 108. The feedback LED may be installed on the validation module to provide feedback regarding the functional status of the validation module 100. The validation module 100 is connected to a power source 114, often provided by the gaming device 22.

The validation module 100 may receive data from the gaming machine 22 via the input/output device 104. For example, the validation module 100 receives information generated and output by the gaming machine 22 (such as via its SAS port), such as whether funds were input to the gaming machine 22 (such as coins input to the coin acceptor 32 or bills or monetary value tickets input to the media reader 34), whether a wager was made via an input device 30, and the like.

The validation module 100 further comprises a transceiver input/output unit 118 that connects to one or more wired or wireless transceivers 120. The validation module 100 may connect directly to one or more networks via the transceiver 120. For example, the validation module 100 may connect to the time since served ("TSS") server 300 (FIG. 2) to track when complementary items such as food or drink are delivered to person at a gaming machine.

Another input/output unit 116 connects the ECU 102 of the validation module 100 to a button or other input device 120. This allows input to the validation module 100 installed at the gaming machine 22, for example. The button or other input 120 may be used by a server, bartender, or the like to indicate when an item such as a beverage was served to a person at the gaming machine.

The validation module 100 drives the LED 130 based on the information received at the validation module 100, such as directly input thereto, or received from the gaming machine 22 and/or from the TSS server 300 via the transceiver 120. For example, once a gaming session is initiated on the gaming machine 22, the validation module 100 may determine whether the activity on the gaming machine 22 has met a certain threshold and/or whether enough time has passed so that the player of the gaming machine meets the requirements to receive service. The validation module 100 may determine that a new player has initiated play at the gaming machine in various manners. For example, a new gaming session may be detected when funds are input to the gaming machine after a long period of inactivity or after a prior "cash out" was performed, or when a new player "cards-in" to the gaming machine by inputting their player tracking card. When the activity meets a certain threshold, then the validation module 100 activates or changes the color of the LED 130. For example, the controller 102 may have setup information stored in a non-volatile memory that stores parameters and thresholds In one embodiment, the validation module 100 allows the gaming establishment to provide complementary items or gifts such as food, beverages, or other items (comps) based on whether patrons are actually playing the gaming machines as compared to patrons who are merely enjoying the atmosphere of the establishment while in a gaming area. The validation module may also track a time since served to provide for regular service to a patron, and to comply with applicable regulations. For example, the validation module may ensure that a host, server, or bartender serves alcoholic beverages at or below a predetermined frequency set by the regulations (whether such service is provided as a comp or is being paid for by the player). The validation module 100 does this by creating a visual cue observable by a host, bartender, waitress, etc. that comps may be issued to certain patrons. In other embodiments, the Validation/TSS server 300 may track the time since service at particular machines or relative to particular players in a centralized fashion. The Validation/TSS server 300 may then send out indicators of when such thresholds have been met to the validation module 100. Also, in such a remote host configuration, an operator may centrally control attributes tracked and displayed at the Validation/TSS server 300 and/or the validation module 100 such as a time threshold for service, for example, based upon time of day or the like, or depending upon which item is being served.

The validation module 100 preferably receives information from the gaming machine 22 regarding activities occurring at the gaming machine. In one embodiment, this information may comprise or include information concerning the funds which the player has associated with the gaming machine (such as via input of value tickets, coins and/or currency), the amount a player is wagering and/or at what frequency the player is wagering. In one embodiment, the validation module 100 utilizes the information regarding the gaming activity to determine a validation status of the player. At a predetermined level, the validation module 100 may light up the LED 130 or provide another visual cue to notify the host that a player is qualified to receive a comp.

In some embodiments, the LED 130 may be configured to emit a plurality of colors of light that provide a host with additional information about a validation status of a particular player at a gaming machine. For example, the LED 130 may include three or more LEDs including a blue LED, a green LED, and a red LED. In some embodiments, illumination of the blue LED may indicate that a player has associated funds with the gaming machine (such as by input of a ticket, currency, coins, etc.) above a predetermined threshold, alerting a host that the player may be initially eligible, or may soon be eligible for a good or service. Illumination of the green LED may indicate that a player has qualified for or is entitled to such, such as because the player has an average wager-rate above a predetermined level. Illumination of the red LED may indicate a secondary validation or qualifying status, such as a "top tier" player status, such as when the player's average wager-rate is higher than a second predetermined level which is greater than the first level. This player may receive greater value awards or awards (whether such are free or reduced-price goods/services) at an increased frequency.

The levels set for a qualified player, a top tier player, or any other service or award level may be programmed into the validation module 100 as desired by the gaming establishment. In one example, the levels may be set based upon an average wager-rate over a given time period. For example, the required wager rate may be $X wagered during a three-minute time period. Periodically, the total value of the wagers placed during a time period are calculated and a wagers-per-minute value is determined and compared to the parameter stored in the memory of the validation module 100. For example, the parameter may be $4.00/minute, or one game every fifteen seconds with a $1.00 bet. Intervals in which the parameters are calculated may be averaged to provide an average which must be maintained above the threshold for the player to be eligible for an award. For example, award or service entitlement might require a player to wager $1 per minute on average during 5-minute intervals. The validation module 100 might determine that the player wagered $5 in the first 5-minute window, $1 in the next 5-minute window and then $20 in the next 5-minute window. The validation module 100 might be configured to average the wagers per time during the intervals to validate the player for an award or service even though the players wagering in the second 5-minute window (of $1) was insufficient, given that the player's overall wagering during the second interval, averaged to include the prior and later intervals ($26/15 minutes) was higher than the threshold.

Other criteria (including calculations) may be utilized to determine whether a player is entitled to an award or service. For example, the parameter may be set to a predetermined amount wagered regardless of the time in which it takes to achieve the amount, a frequency of wagering without a specified amount wagered for each game, or the like.

The validation module 100 may also be configured to motivate a player to achieve certain play levels to be eligible for an award or service. For example, the validation module 100 may flash the LED light 130 as a warning to a player that the player is in jeopardy of losing their entitlement or status unless he or she increase his or her game play. A host may also remind a player that he or she can remain eligible if they continue to play at the gaming machine. Further, the LED light may begin to flash when a player has almost achieved a threshold level for an award or service, motivating the player to continue playing.

A method of operating the validation module 100 to will be described with reference to FIG. 4. In step 402, a validation module is installed relative to one or more gaming devices. For example, as described above, a validation module 100 is installed at a gaming machine 22, such as by location of the module 100 at or near the gaming machine with a connection to the SAS port thereof. In step 404, one or more thresholds are programmed into or set at the validation module. Such thresholds may include a predetermined amount wagered, an average amount wagered over time, etc. Different levels for receiving different types or amounts of awards may also be set.

In step 406, the validation module receives gaming information from the gaming device about the game play on the gaming device. For example, the validation module may receive information about funds associated with the gaming machine by a player and amounts wagered at the gaming device. Step 406 may be ongoing throughout a gaming session at the gaming device or may be completed periodically.

In step 408 it is determined whether the gaming activity meets one or more predetermined thresholds. Based upon this determination, one or more visual indications of validation status may be provided. In one embodiment, if a player is not validated for or entitled to an award or service, a visual indication of such status could be provided. Preferably, if a validation threshold is met, then the validation module 100 provides a visual notification that the player is eligible, as in step 410. For example, the validation module may light a green LED to indicate to the host the player at the gaming device has met a first level of eligibility or may light a red LED to indicate that the player has met a second or higher level of eligibility. If the gaming activity does not meet a predetermined threshold, then the method proceeds to step 412.

In step 412, it is determined whether the gaming activity is within a predetermined range of the threshold. When the gaming activity is not within a predetermined range, the method may return to step 406 to continue monitoring the gaming information. When the gaming activity is within a predetermined range, the method proceeds to step 414.

In step 414, it is determined whether the player at the gaming device was previously eligible. If so, in step 416, the validation module provides a visual indication that the player is losing his or her qualification for an award or service. For example, the validation module may cause the red LED to flash to notify player directly or for the host to remind the player, that he or she is losing a level, and that the level may be regained through increased wagering activity.

When it is determined in step 414 that the gaming device was not previously qualified for an award or service the method proceeds to step 418. In step 418, the validation module may provide a visual notification that the player is almost qualified. The validation module might, for example, cause the green LED to flash to indicate to the player or host that the player is close to achieving a qualified level. After steps 416 and 418, the method returns to step 406 to continue monitoring gaming activity.

In one embodiment, the method may include other steps. For example, when a player associates funds with a gaming machine, the validation module may evaluate the amount of funds which were provided to the machine. If the amount of funds exceeds a threshold, a visual indication might be provided. For example, a blue LED might be illuminated. The host might then provide an initial comp to the player or then closely monitor the module in anticipation that the player may shortly achieve the first or base threshold eligibility which is based upon actual amounts wagered.

Several advantages may be gained by using the system, device, and method described herein. For example, by implementing the invention described herein, a gaming establishment can reduce the distribution of excessive complimentary gifts, such as food or beverages, without confirmation that minimum thresholds of entitlement have been met. With the visual indications such as the LEDs that may turn on, off, and blink, the operator can set validation or entitlement thresholds which must be met and be provided with visual indications of entitlement. This makes it possible for bartenders, hostesses and other personnel to know when a player is or is not entitled to comps.

The thresholds may be determined by the validation module in real time to validate the wagering at the gaming devices which allows for a more structured approach to issuing complimentary gifts. This allows the gaming establishment to save money to assure that minimum wagers for receiving complementary gifts or awards are being met before issuing such gifts. Further, hosts or bartenders no longer have to guess whether a particular player is eligible for such free gifts (such as by trying to simply watch a player to see if they are wagering at a machine or just sitting at the machine, etc.).

Further, the disclosed embodiments encourage more play at the gaming machines than would otherwise take place. This is due to the real-time notification to both the hosts and players of whether the player has met a level for complimentary gifts or awards. When the LED flashes that a player is in jeopardy of losing a compensation level or that a player is close to receiving comps, the player is encouraged to wager more to maintain their comp privileges.

It will be appreciated the validation module may include other or additional features. For example, the validation module may interface with a mobile device and an application on a mobile device of a player to provide the player with a real-time information on a qualification level for receiving complementary gifts. Such information may also be relayed through a gaming network to hosts or bartenders on a computing device such as a computer or mobile device. This allows the host or bartenders to see in real time where players in the gaming establishment are located that are eligible for an award or service. The validation module might also communicate with externals systems, such as an external host, such as to report validation status information, etc. to the host. The host might communicate with other systems, such as a bar's POS system which tracks information regarding drinks which are distributed or the like, such as to link actual comps or rewards to determined validation status. Such information may be useful to confirm that drinks or other comps are only being delivered when a player qualifies, to confirm the rate of comp delivery to rate of wagering, etc., to further validate the cost of the comps to the host to the income which is being received from the players.

In other embodiments, the host or bartender may be able to "reset" the validation module after providing a player with an award or otherwise serving the player (e.g. whether the award or service is complimentary or paid for). For example, the host may have an application on a mobile device that is interconnected with a plurality of validation modules attached to the gaming machines. When the host provides an award or service to one of the eligible player, the host may reset the validation module for that player. This restarts an eligibility criterion for the player to earn an additional award or service.

Figure 5:
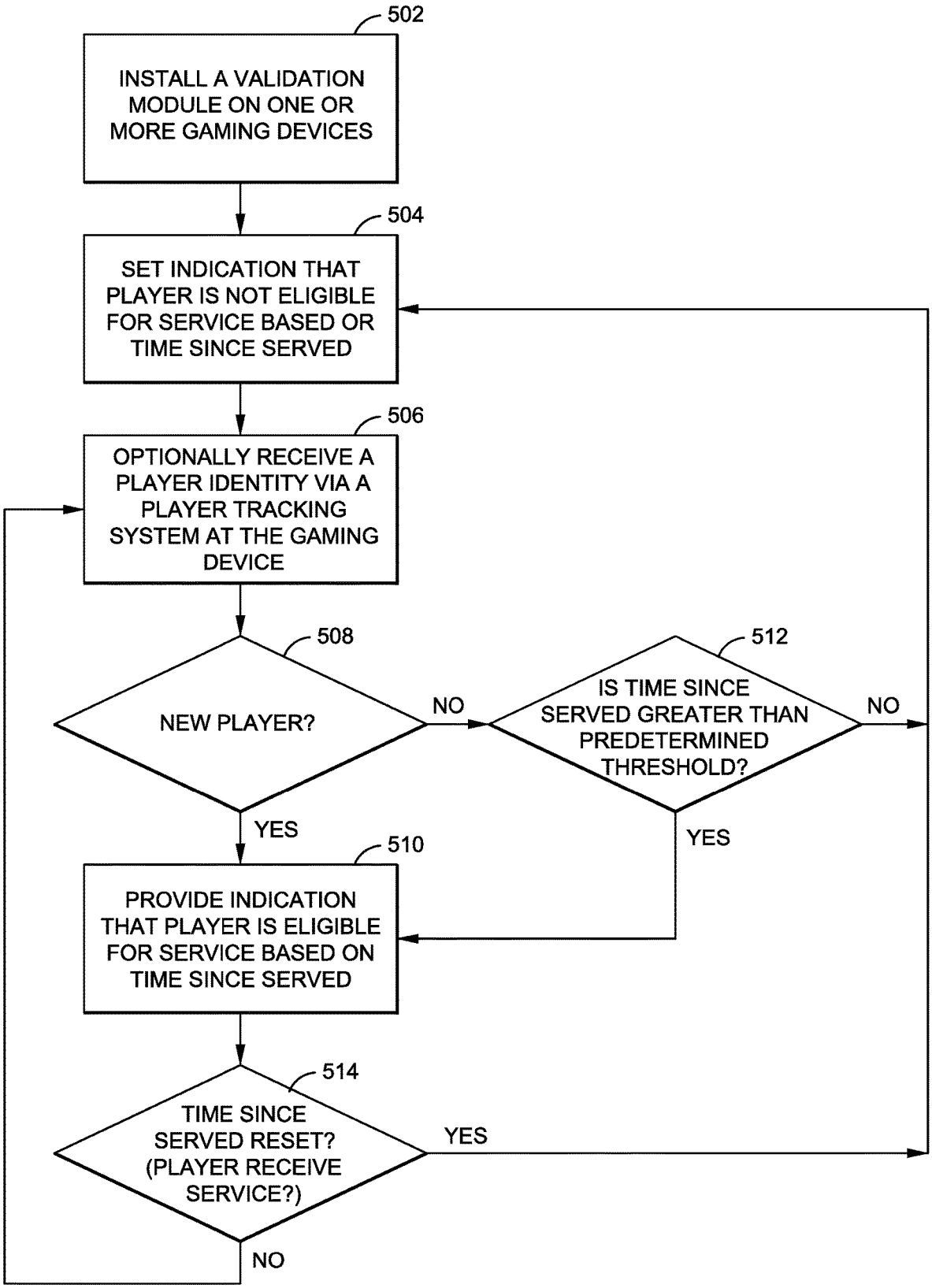
FIG. 5 shows an exemplary process for using a validation module as a time since served module to provide items to a patron.

In some embodiments, the validation module may alternatively track or might also track the time since the patron was last served as another criterion for determining whether a patron is eligible for an award or services. Further, the validation module may track the award or service of certain products, whether the products are served complimentary or are paid for. As mentioned above, a host, bartender, or server may need to track the frequency that alcoholic beverages are served to each patron to comply with local regulations. FIG. 5 shows an exemplary process for using a validation module as a time since served ("TSS") module to provide items to a patron.

In step 502, a validation module is installed relative to one or more gaming devices. For example, as described above, a validation module 100 is installed at a gaming machine 22, such as by location of the module 100 at or near the gaming machine with a connection to the SAS port thereof. However, the validation module used as a TSS may also be installed in other environments, such as at tables at a restaurant, seats at a bar, etc.

When used is such environments, the validation module may have other configurations. For example, the validation module may be configured as a stand-alone device, or to integrate with the features of bar-top gaming machines or gaming tables. In a stand-alone configuration, the validation module might include its own card reader so that a player may card-in to the device directly. In a stand-alone configuration, the validation module may include software for implementing the described method. In other embodiments, such as in a networked environment, aspects of the method may be implemented by software executed at a remote host/server (e.g. TSS server 300).

In step 504, the validation module 100 sets an indication that the patron is not eligible for service, such as for a complimentary item, or for a regulated item, based on the TSS. That is, the validation module 100 sets the indication as an initial default setting to show that the patron is not eligible for service.

The indication may be displayed both at the validation module 100, and at a remote host device. For example, the validation module 100 may be configured such that the ECU 102 controls the LED 130 or other visual indicator associated with the validation module 100 to display an indication that the patron at the gaming machine 22 is not eligible to be served a product based on TSS. For instance, the LED 130 may show a certain color, may flash a certain pattern, etc. In one embodiment, a dedicated color of the LED 130 may be used to indicate that the patron is not eligible to be served a product as compared to other colors indicating that the player may be served. For example, the color white may indicate that the patron may not be served based on TSS. This is compared to the LED displaying the color purple to indicate that the patron is eligible for service. Another color, such as yellow, may provide feedback to the user to inform the patron that they are almost again eligible to be served. For example, the LED 130 may remain white during a first half of the required TSS and then may turn yellow during the second half of the required TSS. Once the TSS has elapsed, the LED 130 may turn purple, indicating eligibility for another service.

Further, the validation module 100 sends the TSS status to the TSS server 300 via the transceiver 120, or through a local gaming network via the SAS 106. The indication may display on the display 310 or on the mobile device 312 of the establishment showing that the patron at that location is not eligible to be served a product based on TSS.

Of course, the Validation/TSS server may centrally track the TSS for the validation module 100 and may send instructions to the validation module 100 to display the indication the patron at the gaming machine is not eligible for service. The display 310 and/or mobile device 312 may show a plurality of locations (e.g., gaming machines) at the establishment and may show each of the TSS status for each location so that the host, server, or bartender may quickly identify which patrons may be served a product, such as a complimentary item, beverage, etc.

In step 506, the validation module 100 optionally receives or confirms a player identity of a patron at the gaming device 22 of location of the validation module 100 via a player tracking system. For example, the validation module 100 receives a player identity of a patron via the link with the gaming machine from a player tracking device on the gaming machine. In other embodiments, the Validation/TSS Server 300 may obtain the player information from a game server 200 such as a player tracking server. In this way, the system may track the play of the patron as well as the items served to the patron while the patron is at the establishment, even if the patron moves from one gaming machine to another gaming machine. For example, the Validation/TSS server 300 maintains a TSS value for a player identity who is identified at a first gaming machine even when the player moves to a second gaming machine is identified at the gaming machine. In other embodiments, the Validation/TSS server 300 integrates with a player tracking server or other existing systems to track the player identity.

In applications where there is no player tracking system, the step may be omitted (e.g. the time since service functionality may be implemented without associating such information with an identified player, but may instead simply be implemented generally), or other identification methods may be used. For example, a host, server, or bartender may scan a government issued identification card, may utilize a separate loyalty program, etc. to track the patron at the establishment to ensure that government regulations and internal policies regarding service to the patron may be followed.

Next, in step 508, it is determined whether a new patron is at the location of the validation module 100. For example, the system identifies when a new player cards in to a player tracking system. The player tracking system allows the establishment to determine whether the patron who cards in at a gaming machine is a new patron, or whether the patron is not a new patron but has simply moved from one gaming machine or area to another. Where there is no player tracking system, a new player may be detected by wagering activity after a long period of inactivity (e.g., long enough to reasonably know that there is a new player at the game) or by activity after an express cash-out at the gaming machine. In other instances, a new player may be manually entered at the validation module 100 via the button or input device 120. In non-gaming environments, a new patron may be set by user such as bartender upon seeing the new patron arriving to the bar in front of an area associated with the button or input device 120 of the validation module 100 or via an input 310 or mobile device 320 associated with the validation module 100.

If a new player is detected, then the method proceeds to step 510. In step 510, the indication is changed to show that the player is eligible for service based on the TSS. As explained above, this may be indicated at the comp device 100 via the LED 130 and/or via an external device, such as the display 310 or mobile device 312 receiving the information from the validation module 100 via the transceiver 120 or SAS 106, or via the Validation/TSS server 300.

If a new player is not detected in step 508, then the method proceeds to step 512. In step 512, it is determined whether the TSS is greater than a predetermined threshold. For example, the TSS may be maintained at either the validation module 100 or the Validation/TSS server 300. When there is not a new player, the TSS continues to increase for the player. Where, a player has moved from one gaming machine or another, the TSS for the player is attached to the player based on the information maintained at the Validation/TSS Server 300 or via integration with a player tracking system. For example, if the TSS for a player at a first gaming machine is 15 minutes out of a 30-minute predetermined threshold, and then the player moves to a second gaming machine, the TSS at the validation module 100 at the second gaming machine is set to 15 minutes so that there is still only 15 minutes remaining until the threshold is met.

The predetermined threshold may be set according to government regulations or by policies of the establishment. For example, the threshold may be to comply with regulations for serving alcoholic beverages. In other instances, the threshold may be set by a casino to ensure that comps are provided to players no faster than a predetermined frequency. If the TSS is greater than the threshold, the method proceeds to step 510 which is described above. If the TSS is not greater than the predetermined threshold, the method returns to step 504.

Returning to step 510, the player remains eligible to be served until it is determined that the player is served in step 514. In step 514, the validation module 100 monitors whether the TSS is reset. For example, when a player at a casino receives a complimentary item or beverage, the host or server may actuate the button or other input 120 to reset the TSS. In some embodiments, the TSS might be reset from the mobile device 312 of a server or from a remote location (which device then communicates with the validation module 100 or with the TSS server which in turn communicates with the validation module), such as by a bartender via the touchscreen 310. The TSS might be set as against a particular player via their name as displayed on the touchscreen 310 or mobile device 312, or via selection of a gaming machine as identified by a list or map, or via direct communication with the validation module 100 at the particular machine.

So long as the player has not received service, the TSS is not reset, and the method proceeds back to step 506. That is, the TSS indication remains as eligible until the patron at that location changes or until the TSS is reset. When the TSS is reset upon serving the patron, the process proceeds to step 504 where the indication is reset to not eligible.

Figure 4:
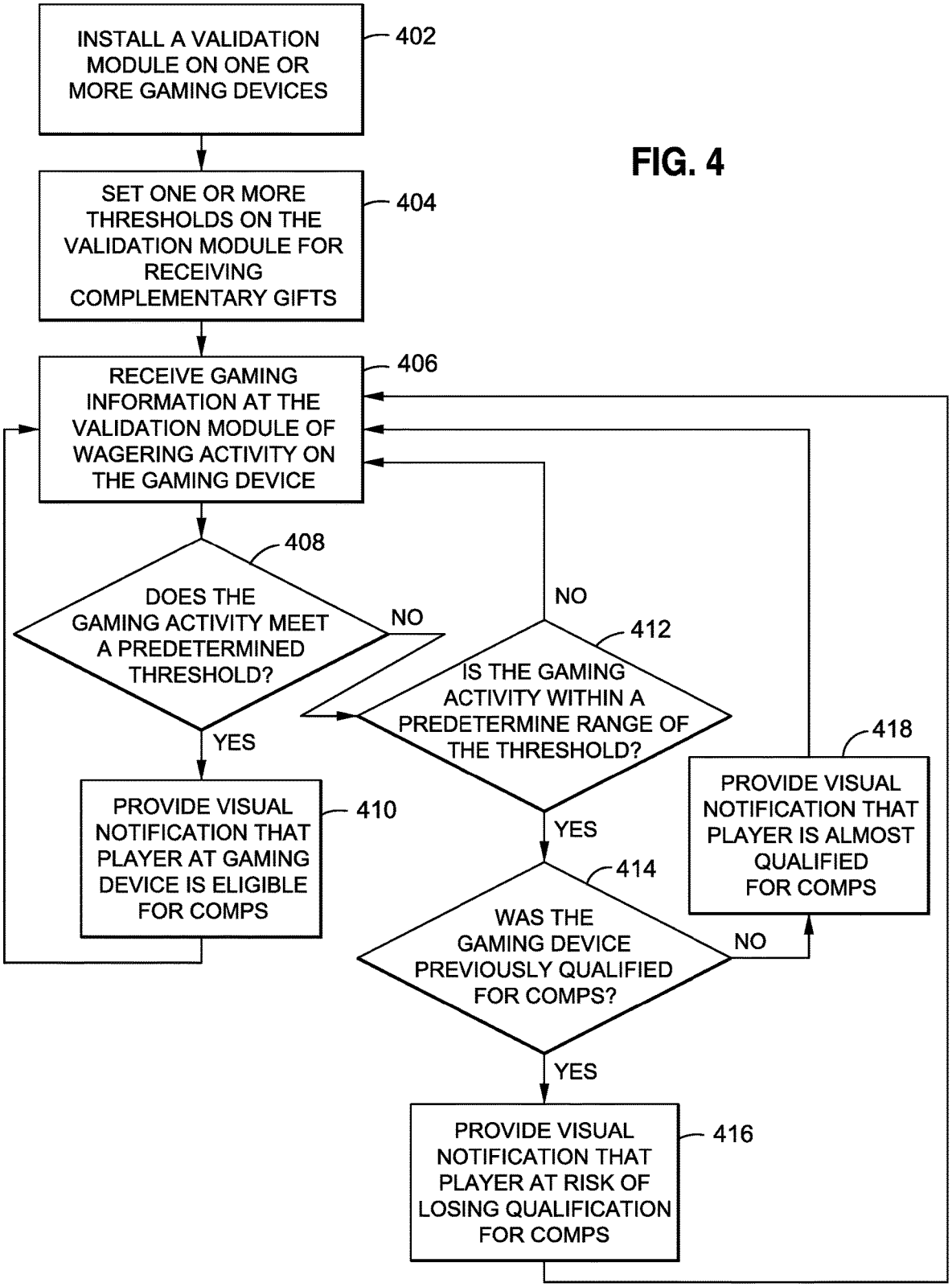
FIG. 4 illustrates a method of patron compensation validation, according to one exemplary embodiment.

It is further noted that the methods described in FIGS. 4 and 5 may operate simultaneously to determine whether a player is eligible for complimentary items or other goods or services. For example, the player may not be eligible until both the gaming activity meets a certain threshold, as explained with reference to FIG. 4, and the TSS meets a predetermined threshold, as explained with reference to FIG. 5. In other embodiments, a combination of the methods explained with reference to FIGS. 4 and 5 may be used simultaneously to determine what is served to a patron. For example, the establishment may provide any type of complimentary items such as discounted or free show tickets, food items, gaming credits, or discounted or upgraded lodging so long as gaming activity meets a predetermined threshold. In contrast, complimentary items such as alcoholic beverages may only be served if both the gaming activity and the TSS meet predetermined thresholds.

In such embodiments, the LED 130 may, for example, comprise multiple LEDs. A first LED may indicate eligibility based on a TSS. For the example, the first LED may display different colors depending on whether the patron is eligible for service (e.g. purple for eligible, white for ineligible, and yellow for almost eligible, as explained above). A second LED may display eligibility based on gaming activity (e.g. green for compensation level achieved, peach and light blue for just under compensation level, red for compensation level not achieved, and pink for premium level, such as ten times a compensation level). Of course, as noted above, in one embodiment instead of having LEDs which can illuminate in different colors, a plurality of different LEDs could be provided and then be selectively illuminated and/or other types of indicates may be provided. Also, in this embodiment where one or more LEDs are used to provide information regarding TSS and one or more other LEDs are used to provide eligibility based upon game play or other activity, the operator might turn off or disable either the TSS functionality or the eligibility based upon game play functionality of the validation module, in which case the associated LED(s) would not be utilized or operate.

In yet further embodiments, the TSS attaches to the type of complimentary item given to a player, so that different complimentary items are served to the player. For example, when the player is eligible for complimentary items and is awarded bonus gaming credits, and TSS for the bonus gaming credits is reset so that the next time the player is offered a complimentary item, the server or host can see that the player is not eligible for additional bonus gaming credits, but should be given a different complimentary item.

Likewise, the time since service functionality may be implemented independent of any other comp validation status functionality. For example, if validation status based upon game play is not utilized, only service time might be tracked and utilized per the TSS functionality. In such an embodiment, it is possible for the validation module 100 to not be connected to the gaming machine in a way that it obtains or tracks game play information. As indicated above, relative to TSS functionality, the validation module might simply be linked to the gaming machine or a player tracking module thereof to obtain player identification information, or the TSS functionality might simply be implemented "anonymously" relative to a player of a gaming machine (e.g. without knowing their identity).

In one embodiment, validation status is dependent upon or determined by an amount of funds associated with a gaming machine and/or amounts wagered by the player over time. Other information or criteria might be utilized, such as based upon tracked player game play.

In one embodiment, the validation module 100 may be programmable or customizable by the operator, such as to set different validation parameters. In one embodiment, the validation module 100 might be modified from the remote Validation/TSS server 300 which is connected to the validation module 100. For example, an operator might be provided with an application or interface at the remote Validation/TSS server or via the mobile device 312 connected to the Validation/TSS server which includes an interface which allows the operator to select various validation parameters. These are then communicated with the processor of the validation module 100 to program or implement the selected parameters.

In another embodiment, the processor might be provided with dip switches or similar input devices which the operator can select to implement different operating parameters which are pre-programmed into the module. For example, there may be seven on-board dip switches that allow the user to configure the board to set threshold parameters. The dip switches may be labeled 1-7. Dip switch 1 may set a minimum funding level (bills, coins, tickets, etc. associated with the machine) to control a blue qualifier LED. Dip switches 2, 3, and 4 may set a minimum-dollars-played-per-minute to control a green qualifier LED. Dip switches 5 and 6 may set an interval (in minutes, seconds, etc.) for the green qualifier LED. Dip switch 7 may set a multiplier of the threshold to qualify as a top tier player to control the red qualifier LED. Example configurations are shown in Tables 1-4 below.

TABLE 1

| Dip Switch 1 (Blue Qualifier) | | |
|---|---|---|
| On | Off | Minimum Wager |
| X | | $20 |
| | X | $10 |

TABLE 2

| Dip Switches 2-4 (Green Qualifier) | | | | | | |
|---|---|---|---|---|---|---|
| Dip Switch 2 | | Dip Switch 3 | | Dip Switch 4 | | Min Wager |
| On | Off | On | Off | On | Off | Per Minute |
| | X | | X | | X | $1.00 |
| X | | | X | | X | $2.00 |
| | X | X | | | X | $3.00 |
| X | | X | | | X | $4.00 |
| | X | | X | X | | $5.00 |
| X | | | X | X | | $6.00 |
| | X | X | | X | | $7.00 |
| X | | X | | X | | $8.00 |

TABLE 3

| Dip Switches 5-6 (Time Intervals) | | | | |
|---|---|---|---|---|
| Dip Switch 5 | | Dip Switch 6 | | |
| On | Off | On | Off | Interval Minutes |
| | X | | X | 3 |
| X | | | X | 6 |
| | X | X | | 9 |
| X | | X | | 12 |

TABLE 4

| Dip Switch 7 (Red Qualifier) | | |
|---|---|---|
| On | Off | Hot Player Multiplier |
| | X | 5 |
| X | | 10 |

The validation module 100 as described above has the particular advantage that it may be used with an existing gaming machine 22 without modifying the gaming machine 22. Modifications to the gaming machine 22, and particularly the code which the machine runs, is associated with regulatory issues. In one example, the validation module 100 is housed in a housing which can be mounted to the exterior of the gaming machine or otherwise be located adjacent to the gaming machine 22. The validation module 100 might, for example, be located on top of the machine so that it is visible to a hostess in a casino environment, or it might be located at the top of the machine or on an adjacent bar surface (such as to be closer or more visible to a bartender). The validation module 100 merely needs to be coupled to a power source (such as an external power source or a gaming machine's power source) and the gaming machine's communication port (such as its SAS port). In this manner, existing or "legacy" gaming machines which do not include any of the functionality described herein can easily be modified or retrofit to provide that functionality.

In one embodiment, the visual indicator(s) are mounted to or are part of the validation module 100. Of course, other configurations might be utilized. For example, the validation module 100 might comprise a small processing unit or box which is positioned at one location (such as at the back of the gaming machine or even within the housing of the gaming machine to be protected from tampering) and a secondary unit or box with which the visual indicators are associated. The secondary unit or box may be located where it is easy to see, such as at the top of the gaming machine 22. Of course, the validation module 100 does not need to be mounted directly to a gaming machine 100. For example, as indicated above the validation module 100 (or at least the visual indicating portion) may be located on or in the bar, such as at the rear of the gaming machine when the gaming machine is a bar top unit.

Of course, it is possible for a gaming machine 22 to be custom manufactured or modified to include the functionality herein. For example, a validation module might be integrated into a gaming machine by locating the processor and the like inside of the gaming machine housing. The visual indicator(s) might be integrated into the gaming machine 22, such as by having LEDs protrude through openings in a top or the side of the gaming machine housing or by having the LEDs associated with a light bar or other feature which is integrated into the gaming machine. In addition, the validation processing may be integrated into the machine, such as by providing game code which the gaming machine's controller directly executes and then controls the associated visual indicators at the machine. In other embodiments, the processing could even be done remotely, such as via a remote host. For example, in one embodiment, a single "validation host" might be provided at a bar. This host might communicate with each gaming machine at the bar and a visual indicator device at each gaming machine. The host may process gaming related information from each machine and then control the visual indicator(s) at each machine.

In the above examples, the systems and method have been described primarily with the use of a casino gaming machine. However, the system and method may also be applied to other gaming environments, such as a player station at casino gaming table or the like. For example, a casino gaming table may define a plurality of player positions. A validation module may be provided relative to each position (or at least visual indicators may be provided relative to each position). The validation module(s) at the gaming table may communicate with a table host, a dealer input device or the like, such as to receive information regarding a player's game play at the gaming table (such as monetary buy-ins, wagers placed via chips or the like, etc., which information may be obtained at the table by dealer input, chip tracking and/or various means). The validation module may then provide a visual output relative to each player at the gaming table as to their validation status and thus their entitlement to awards or service.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A player validation system comprising:

a gaming device comprising:

a controller;

at least one electronic display;

at least one wager accepting device configured to receive a physical item representing a monetary value to increase a credit balance maintained at the gamine device; and at least one player input device configured to place a wager on a game of presented at the gaming device; and a player validation module that is disposed on the gaming device to be at least partially viewable externally from the gaming device separately from the at least one electronic display and is configured to be integrated with the gaming device, the player validation module comprising at least one illumination device configured to generate a visually discernable illumination output, the player validation module being configured to:

receive information from the gaming device of one or more wagers placed during the game presented at the gaming device via the at least one player input device;

track a time since served value representing elapsed time since a product was served to a patron at the gaming device; and generate at least one visual notification output via the at least one illumination device based on the information of the one or more wagers placed and the time since served value.

2. The player validation system of claim 1, wherein the at least one illumination device comprises one or more LEDs.

3. The player validation system of claim 1, wherein the player validation module generates a first visual notification output via the at least one illumination device when an amount of the one or more wagers reaches or exceeds a predetermined threshold, wherein the first visual notification output indicates to a host/hostess that a player at the gaming device is eligible to be served a complimentary item from the host/hostess.

4. The player validation system of claim 1, wherein the player validation module generates a first visual notification output via the at least one illumination device when an amount of the one or more wagers reaches or exceeds a predetermined threshold during a given time period, wherein the first visual notification output indicates to a host/hostess that a player at the gaming device is eligible to be served a complimentary item from the host/hostess.

5. The player validation system of claim 1, wherein the player validation module generates a first visual notification output via the at least one illumination device when an amount of the one or more wagers on average reaches or exceeds a predetermined threshold during a given time period, wherein the first visual notification output indicates to a host/hostess that a player at the gaming device is eligible to be served a complimentary item from the host/hostess.

6. The player validation system of claim 1, wherein the player validation module generates a first visual notification output via the at least one illumination device when an amount of the one or more wagers reaches or exceeds a first predetermined threshold, and a second visual notification output via the at least one illumination device when an amount of the one or more wagers reaches or exceeds a second predetermined threshold greater than the first predetermined threshold.

7. The player validation system of claim 1, wherein the player validation module generates a first visual notification output via the at least one illumination device when an average amount of the one or more wagers during a given time period reaches or exceeds a predetermined threshold, and a second visual notification output via the at least one illumination device when an average amount of the one or more wagers during a given time period falls below a predetermined threshold.

8. The player validation system of claim 1, wherein the player validation module comprises an input device, the player validation module being configured to reset the time since served value upon an input from the input device.

9. The player validation system of claim 8, wherein the player validation module generates a first visual notification output via the at least one illumination device indicating eligibility to a host/hostess that a player at the gaming device is eligible to be served a complimentary item from the host/hostess based on the time since served value, and a second visual notification output via the at least one illumination device indicating ineligibility based on the time since served value.

10. The player validation system of claim 9, wherein when the input from the input device is received and the time since served value is reset, the player validation module generates the second visual notification output.

11. The player validation system of claim 9, wherein the player validation module is configured to receive an indication from the gaming device of a new player detected at the gaming device, and wherein when the new player is detected, the player validation module is configured to display the first visual notification output.

12. A method for validating player entitlement to a good or service, the method comprising:

providing a gaming device comprising a controller, at least one electronic display, at least one wager accepting device configured to receive a physical item representing a monetary value to increase a credit balance maintained at the gamine device, and at least one player input device configured to place a wager on a game of presented at the gaming device;

connecting a player validation module to the gaming device and communicatively integrating the player validation module to the gaming device, the player validation module comprising at least one visual notification output that is viewable externally from the gaming machine separate from the at least one electronic device;

receiving information from the gaming device at the player validation module of one or more wagers placed during the game presented at the gaming device via the at least one player input device;

tracking a time since served value representing elapsed time since a product was served to a patron at the gaming device; and providing at least one visual notification via the at least one visual notification output based on the information of the one or more wagers placed and the tracked time since served value.

13. The method of claim 12, wherein the at least one visual notification output comprises the illumination of one or more LEDs.

14. The method of claim 12, wherein the player validation module provides the at least one visual notification when an amount of the one or more wagers reaches or exceeds a first predetermined threshold and the time since served value reaches or exceeds a second predetermined threshold, and wherein the at least one visual notification indicates to a host/hostess that a player at the gaming device is eligible to be served a complimentary item from the host/hostess.

15. The method of claim 14, wherein the player validation module provides the at least one visual notification when the amount of the one or more wagers reaches or exceeds the first predetermined threshold during a given time period.

16. The method of claim 12, wherein the player validation module provides the at least one visual notification when an average amount of the one or more wagers on average reaches or exceeds a first predetermined threshold during a given time period and the time since served value reaches or exceeds a second predetermined threshold, and wherein the at least one visual notification indicates to a host/hostess that a player at the gaming device is eligible to be served a complimentary item from the host/hostess.

17. The method of claim 12, wherein the at least one visual notification comprises a first visual notification when an amount of the one or more wagers reaches or exceeds a first predetermined threshold, and a second visual notification when an amount of the one or more wagers reaches or exceeds a second predetermined threshold greater than the first predetermined threshold.

18. The method of claim 12, wherein the at least one visual notification comprises a first visual notification when an average amount of the one or more wagers during a given time period reaches or exceeds a predetermined threshold, and a second visual notification when an average amount of the one or more wagers during a given time period falls below a predetermined threshold.

19. A player validation module comprising:

a mount configured to connect the player validation module externally to a gaming device;

a gaming device interface configured to integrate the player validation module to the gaming device to send and receive information from the gaming device and a gaming system connected to the gaming device;

at least one input device;

at least one visual indicator; and an electronic control unit configured to control the gaming device interface, receive an input signal from the at least one input device, and activate the at least one visual indicator, the electronic control unit executing machine readable instruction to cause the player validation module to:

receive information from the gaming device of one or more wagers placed by a patron during one or more games presented at the gaming device;

track a time since served value representing elapsed time since a product was served to the patron at the gaming device;

provide a visual notification via the at least one visual indicator to signify that the patron is eligible to be served a complimentary item based on the one or more wagers and the time since served value.

20. The player validation module of claim 19, wherein the time since served value is reset when the electronic control unit receives the input signal from the at least one input device, wherein the player validation module is configured to receive information from the gaming device of a player identity of the patron at the gaming device, and wherein the visual notification is provided based on the player identity.

* * * * *